US006035863A

United States Patent [19]

Mao

[11] Patent Number: 6,035,863

[45] Date of Patent: Mar. 14, 2000

[54] HAIR CLIP DEVICE

[76] Inventor: Chun-Pi Mao, 14, Lane 342, Kai Yuan Rd., Tainan, Taiwan

[21] Appl. No.: 09/246,376

[22] Filed: Feb. 8, 1999

[51] Int. Cl.[7] ..... A45D 8/04; A45D 8/00; A45D 8/20; A45D 8/22

[52] U.S. Cl. ..... 132/273; 132/276; 132/277; 132/278

[58] Field of Search ..... 132/273, 274, 132/275, 276, 277, 278, 279; D28/38, 39, 40, 41

[56] References Cited

U.S. PATENT DOCUMENTS 4,550,742 11/1985 Stearns ..... 137/14
5,494,060 2/1996 Potut ..... 132/277
5,697,388 12/1997 Chang ..... 132/277
5,803,096 9/1998 Lee ..... 132/277
5,868,815 1/1999 Murphy et al. ..... 132/277

*Primary Examiner*—John J. Wilson
*Assistant Examiner*—Robyn K. Doan
*Attorney, Agent, or Firm*—Alan Kamrath; Oppenheimer, Wolff & Donnelly LLP

[57] ABSTRACT

A hair clip device has an elastic retainer, and two clamp devices. The elastic retainer engages with the clamp devices. Each clamp device has a blocking plate, two oblong holes, and two protruded bars. The elastic retainer has a slot, two through holes, and two distal click plates. Each distal click plate has a recess. Each through hole receives an upper portion of the respective clamp device.

3 Claims, 5 Drawing Sheets

HAIR CLIP DEVICE

BACKGROUND OF THE INVENTION

The present invention relates to a hair clip device. More particularly, the present invention relates to a hair clip device which can fasten a strand of hair stably.

Referring to FIG. 5, a first conventional hair clip device has a first clamp device 10, a second clamp device 10' engaging with the first clamp device 10, and a pivot pin 30 disposed between the first clamp device 10 and the second clamp device 10'. The first clamp device 10 has a first press portion 20, and two first lugs 201. The second clamp device 10' has a second press portion 20', and two second lugs 201'. A tension spring 40 encloses the pivot pin 30. The tension spring 40 has a first linear end 401 blocking the second press portion 20' and a second linear end 402 blocking the first press portion 20. The pivot pin 30 passes through the first lugs 201 and the second lugs 201'.

Referring to FIGS. 6 and 7, a second conventional hair clip device has a first clamp device 50, a second clamp device 50' engaging with the first clamp device 50, and two retainer devices 60. The first clamp device 50 has two first connection lobes 501, and a plurality of first oblong holes 503. Each of the first connection lobes 501 has a pivot block 502. The second clamp device 50' has two second connection lobes 501', and a plurality of second oblong holes 503'. Each of the second connection lobes 501' has a round aperture 502'. Each of the retainer devices 60 passes through the respective first oblong hole 503 and the respective second oblong hole 503'. Each pivot block 502 is inserted in the respective round aperture 502'.

SUMMARY OF THE INVENTION

An object of the present invention is to provide a hair clip device which can fasten a strand of hair stably.

Accordingly, a hair clip device comprises an elastic retainer, and two clamp devices. The elastic retainer engages with the clamp devices. Each of the clamp devices has a blocking plate, two oblong holes, and two protruded bars. Each of the protruded bars is adjacent to the respective oblong hole. The elastic retainer has a slot, two through holes, and two distal click plates. Each of the distal click plates has a recess. Each of the through holes receives an upper portion of the respective clamp device.

BRIEF DESCRIPTION OF THE DRAWINGS

FIG. 1A is a sectional view taken along line 1A—1A in FIG. 1;

FIG. 1B is a sectional view taken along line 1B—1B in FIG. 1;

FIG. 1C is a sectional view taken along line 1C—1C in FIG. 1;

DETAILED DESCRIPTION OF THE INVENTION

Figure 1:
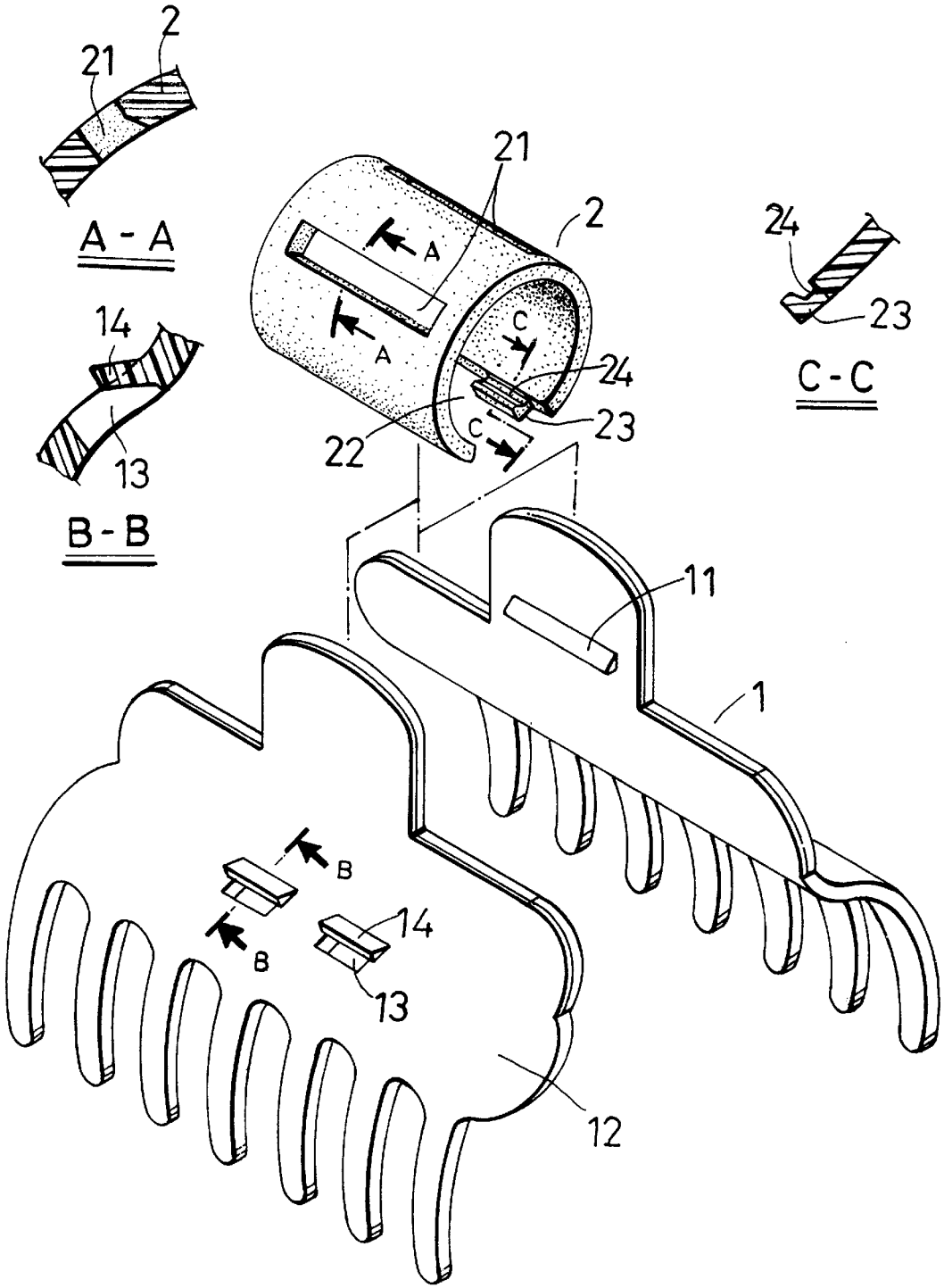
FIG. 1 is a perspective exploded view of a hair clip device of a preferred embodiment in accordance with the present invention.
Figure 2:
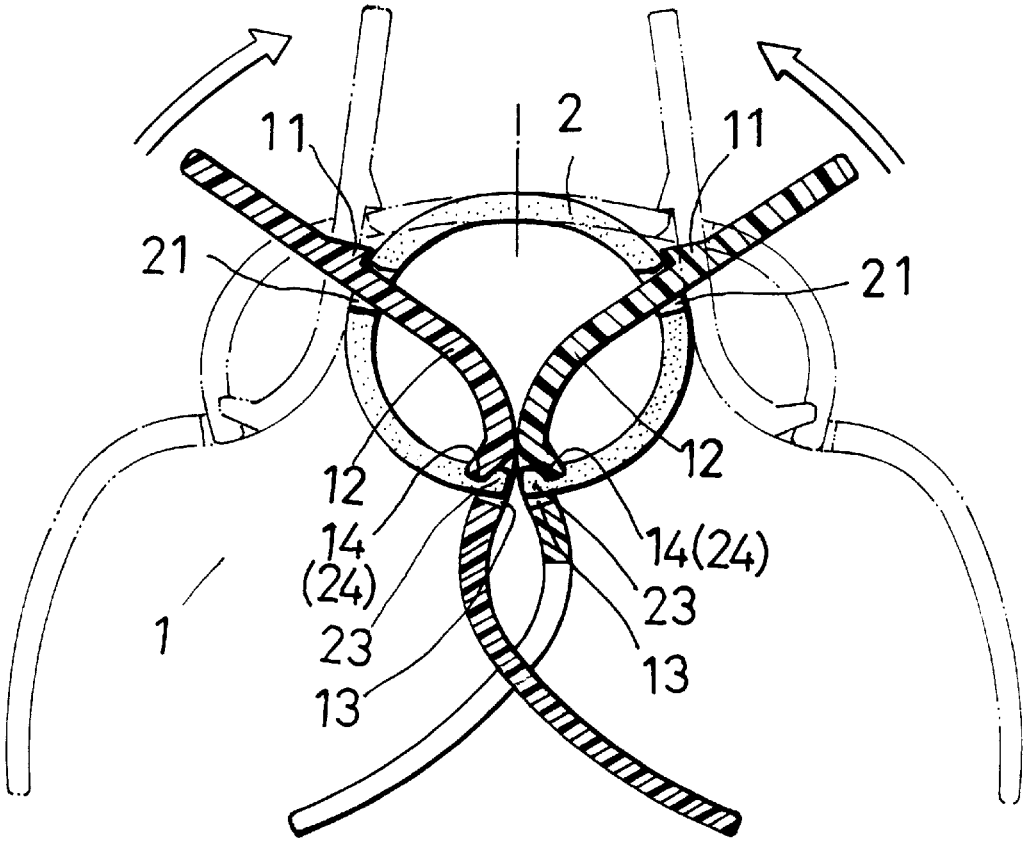
FIG. 2 is a sectional assembly view of a hair clip device of a preferred embodiment in accordance with the present invention.

Referring to FIGS. 1 to 4, a hair clip device comprises an elastic retainer 2, and two clamp devices 1. The elastic retainer 2 engages with the clamp devices 1. Each of the clamp devices 1 has a blocking plate 11, two oblong holes 13, and two protruded bars 14. The clamp devices 1 are identical. Each of the protruded bars 14 is adjacent to the respective oblong hole 13.

The elastic retainer 2 is made of a reinforced plastics. The elastic retainer 2 has a slot 22, two through holes 21, and two distal click plates 23. Each of the distal click plates 23 has a recess 24.

Each of the through holes 21 receives an upper portion of the respective clamp device 1. Each blocking plate 11 blocks the elastic retainer 2.

Each of the distal click plates 23 is inserted in the respective oblong hole 13.

Figure 3:
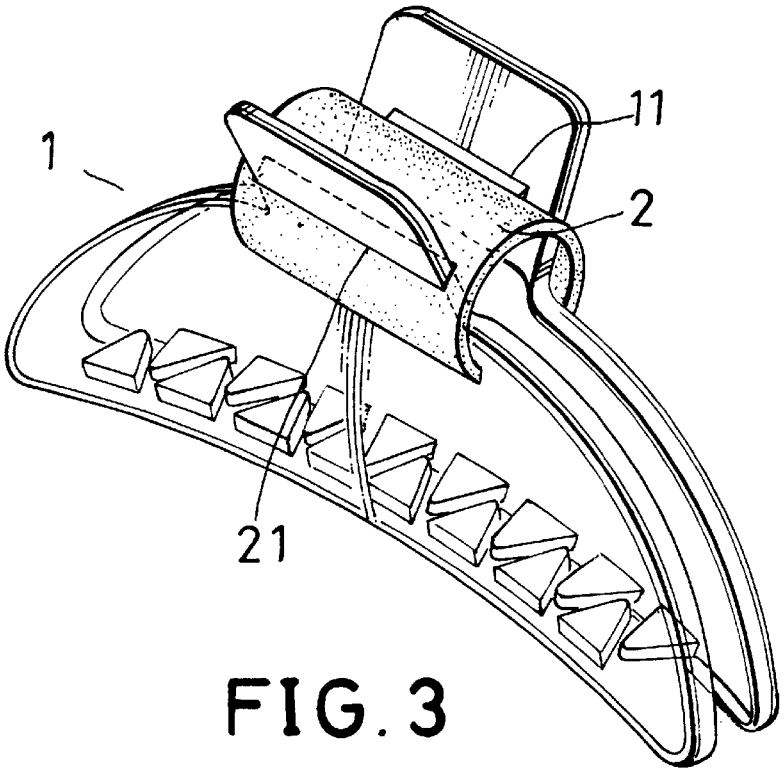
FIG. 3 is a perspective assembly view of a hair clip device of a preferred embodiment in accordance with the present invention.
Figure 4:
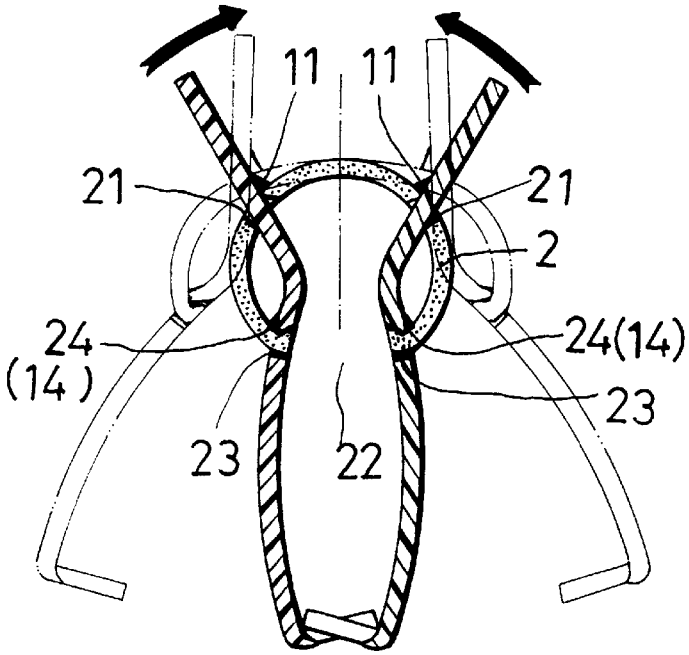
FIG. 4 is a schematic view illustrating an operation of a hair clip device of a preferred embodiment in accordance with the present invention.
Figure 5:
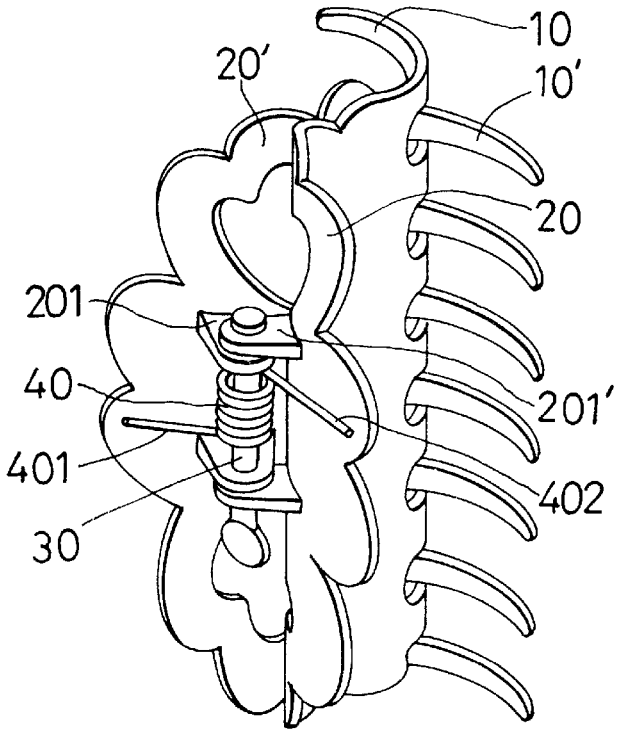
FIG.5 PRIOR ART
FIG. 5 is a perspective view of a conventional hair clip device of a first prior art.
Figure 6:
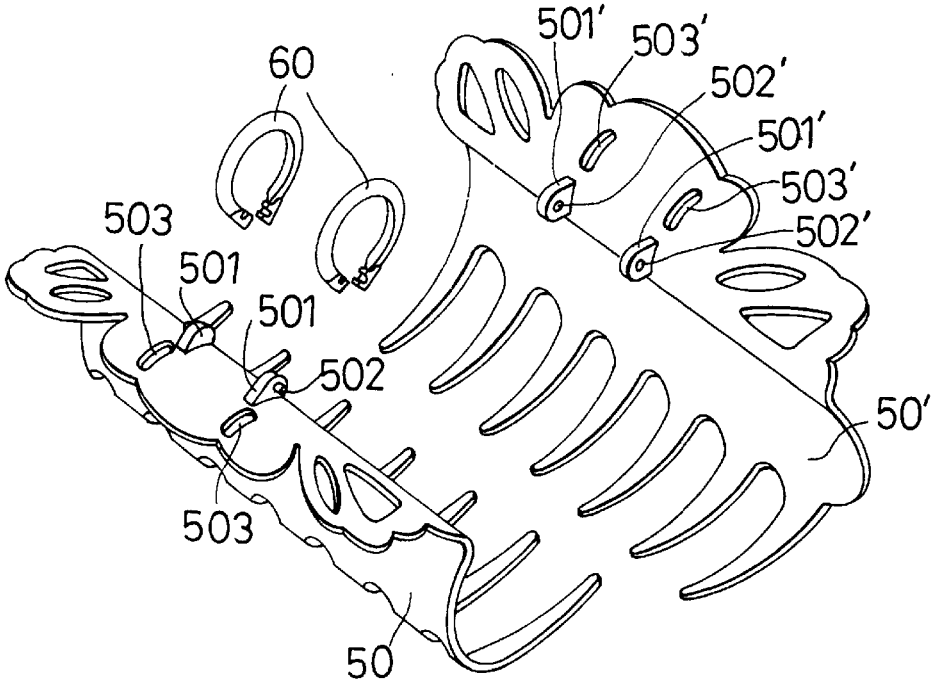
FIG.6 PRIOR ART
FIG. 6 is a perspective exploded view of a conventional hair clip device of a second prior art.
Figure 7:
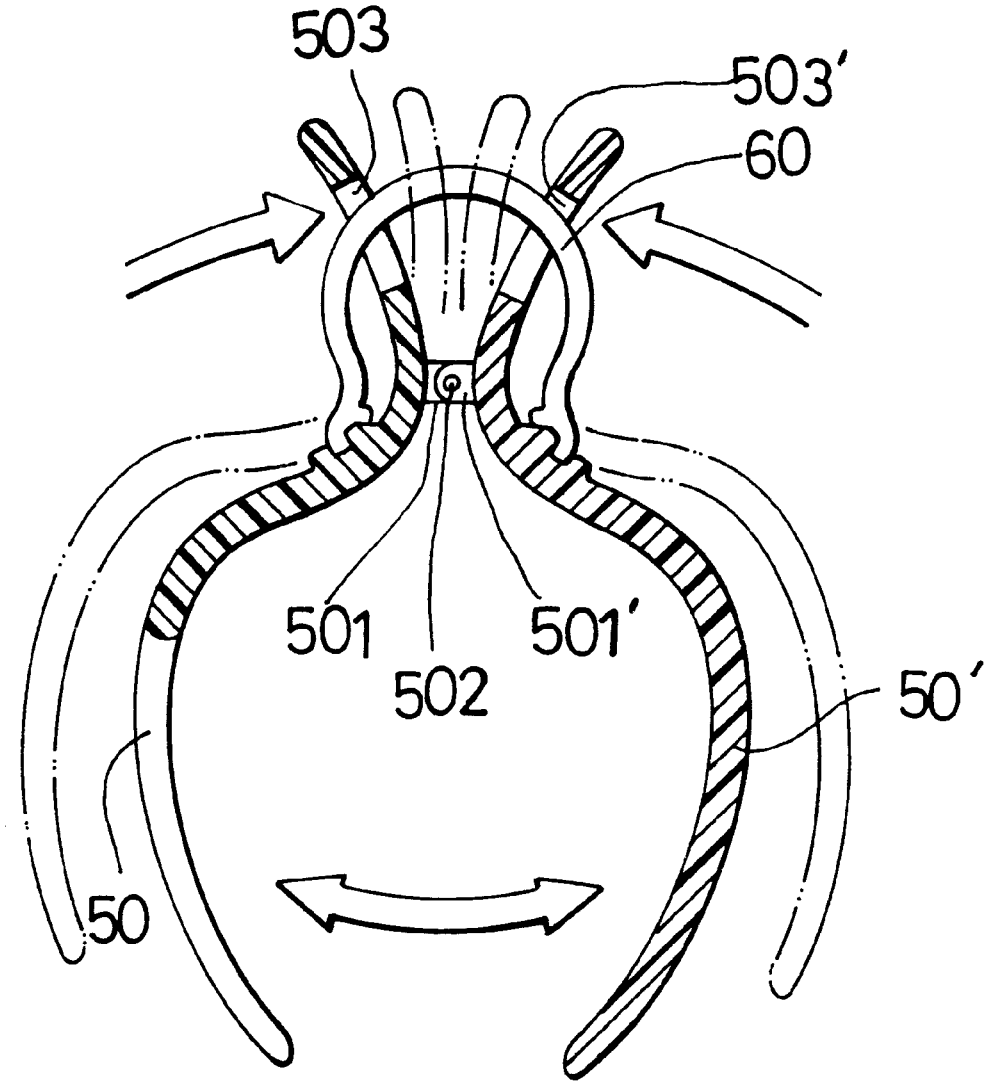
FIG.7 PRIOR ART
FIG. 7 is a sectional assembly view of a conventional hair clip device of a second prior art.

Referring to FIGS. 3 and 4, each of the clamp devices 1 has a serrated lower portion.

Since the clamp devices 1 are identical, the various elements of the present invention can be reduced. It is easy to assemble the hair clip device of the present invention.

I claim:

1. A hair clip device comprising:

an elastic retainer, and two clamp devices, the elastic retainer engaging with the clamp devices, each of the clamp devices having a blocking plate, two oblong holes, and two protruded bars, each of the protruded bars adjacent to the respective oblong hole, the elastic retainer having a slot and two through holes, and each of the through holes receiving an upper portion of the respective clamp device.

2. A hair clip device as claimed in claim 1, wherein the elastic retainer further has two distal click plates.

3. A hair clip device as claimed in claim 2, wherein each of the distal click plates has a recess.

* * * * *